US008020592B2

(12) United States Patent
Nicolson

(10) Patent No.: US 8,020,592 B2
(45) Date of Patent: Sep. 20, 2011

(54) PLANER

(75) Inventor: Marcus Nicolson, York (GB)

(73) Assignee: Power Box AG, Geneva (CH)

( * ) Notice: Subject to any disclaimer, the term of this patent is extended or adjusted under 35 U.S.C. 154(b) by 383 days.

(21) Appl. No.: 12/154,470

(22) Filed: May 23, 2008

(65) Prior Publication Data

US 2008/0314477 A1 Dec. 25, 2008

(30) Foreign Application Priority Data

May 25, 2007 (GB) ..... 0710034.0

(51) Int. Cl.
*B27C 1/00* (2006.01)

(52) U.S. Cl. ..... 144/117.4; 144/114.1

(58) Field of Classification Search ..... 144/48.5, 144/136.95, 154.5, 114.1, 117.1, 251.1, 251.2, 144/251.3, 252.1, 252.2; 30/475–493, 391; 409/228–302

See application file for complete search history.

(56) References Cited

U.S. PATENT DOCUMENTS 2,705,034 A * 3/1955 Gaskell ..... 144/251.3
5,022,447 A * 6/1991 Monobe ..... 144/251.1
5,094,000 A * 3/1992 Becht et al. ..... 30/475
5,595,227 A * 1/1997 Varley ..... 144/253.6
5,815,934 A * 10/1998 Eichberger et al. ..... 30/475
6,014,813 A * 1/2000 Merino ..... 30/391
6,502,475 B2 * 1/2003 Garcia et al. ..... 74/332
6,543,143 B2 * 4/2003 Moore et al. ..... 30/391
7,020,970 B1 * 4/2006 Welch ..... 30/391
7,426,787 B2 * 9/2008 Tracy et al. ..... 30/391
7,472,729 B2 * 1/2009 Bettacchini ..... 144/251.1
7,527,080 B2 * 5/2009 Bettacchini ..... 144/114.1
2002/0020068 A1 * 2/2002 Hartmann ..... 30/388
2003/0136011 A1 * 7/2003 Refson ..... 30/391
2004/0060178 A1 * 4/2004 Willer et al. ..... 30/391
2006/0207683 A1 * 9/2006 Park et al. ..... 144/136.95

* cited by examiner

*Primary Examiner* — David J. Walczak
*Assistant Examiner* — Jennifer C Chiang
(74) *Attorney, Agent, or Firm* — Head, Johnson & Kachigian, P.C.

(57) ABSTRACT

The invention provides a power tool planer which includes a drum with at least one blade thereon located within a chamber in the tool housing. One end of the chamber is provided with an opening which can be selectively closed by a guard. The guard can be moveable between a first closed position and a second position in which the chamber is opened, and the guard is moved into a recess in the housing to improve the ability to use the tool in confined spaces, as the guard lies flush with a side wall of the housing. Also provided is a dust and debris extraction system and a means for adjusting the depth of cut obtained using the tool.

7 Claims, 10 Drawing Sheets

PLANER

CROSS-REFERENCES TO RELATED APPLICATIONS

This United States Application claims priority to British Patent Application No. 0710034.0 filed 25 May 2007.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The invention to which this application relates is a power tool in the form of a planer which can be used to remove portions of material from a workpiece surface along which the planer is moved.

The planer includes a base surface which is used to contact the surface of the workpiece from which the material is to be removed. A drum is provided within the housing which is positioned adjacent to the base and the drum includes one or more blades mounted thereon. The drum protrudes a selectable distance from the base and the blades, as they rotate, cause removal of the material of the workpiece. The drum is typically driven by connection to a motor located in the housing. The motor is preferably mounted substantially above the drum with respect to the workpiece on which the planer is being used. In addition, debris removal means can be provided within the housing in the form of one or more channels which depend from the chamber in which the blade drum is mounted to one or more openings in the housing and which allow debris to be moved from the blade chamber and deposited to the rear or side of the planer.

This form of planer is relatively well known, and there are numerous patents in relation to the same. One known problem with planers is that access to certain surfaces which are to be planed can be difficult due to protrusions on the side walls of the planer clashing with parts of the workpiece. This, in combination with the fact that the edges of the blades of the drum are offset from the edge of the planer housing, means that there can be portions, particularly side edges, of the workpiece which are not accessible by the planer to plane the same. A further problem is ensuring that the safety requirements for use of the planer can be achieved whilst trying to ensure the widest possible application of the planer.

An aim of this invention is to provide further improvements to the planer which render the use of the same more effective and efficient for the user.

BRIEF SUMMARY OF THE INVENTION

In a first aspect of the invention, there is provided a planer power tool. The tool incorporating a base which contacts with a workpiece from which portions of material are to be removed by the tool passing therealong, and a housing depending from the base and in which is mounted a drum in a chamber. The drum includes at least one blade mounted thereon. The drum is driven by a motor provided as part of the tool to rotate and move the blades into contact with the workpiece to remove material therefrom. There is provided a guard located to be movable between first and second positions, a first position masking an opening to one side of the chamber in which the blade drum is mounted, and a second position in which the opening to the chamber is exposed.

Typically, the guard has two movement components between the first and second positions, one movement component being a pivotal movement between the first position and an intermediate position. Typically, a pivot axis, about which the guard moves, is located at an offset distance from the opening into the chamber. In one embodiment, the pivot axis is located towards the front of the planer from the chamber.

Typically, the guard is movable between the first and second positions via user manipulation of an actuation means, such as a lever or slide (hereinafter referred to as a lever). The lever is located on the housing at a position remote from the guard. Typically, the lever is located at a position at which the same can be operated by the user when gripping the planer in normal operation.

Typically, the lever is mounted adjacent to a gripping handle provided on the housing. In a preferred embodiment, movement between the first, closed and second, opened positions comprises the guard moving pivotally in the first movement component from the closed position to an intermediate position removed from the chamber opening and then from the intermediate position to the second, opened position in which the guard moves into a recess so that the external surface of the guard lies substantially flush with the adjacent side wall of the housing.

Typically, movement from the second, opened to the first, closed position involves an axial movement to the intermediate position and then a pivotal movement to the first, closed position.

The provision of the two movement components allows the guard, when in the opened position, to have its external surface lie substantially flush with an adjacent external surface of the housing. The axial movement between the opened position and the intermediate position allows the guard to be moved clear of an external surface of the housing and then allows the same to be pivotally movable to the closed position.

When in the opened position, as the guard lies flush with the housing side wall, the guard does not provide any obstruction on the side wall to the use of the planer, and as a result the planer can be used to cut relatively confined rebated surfaces without limitation. Thus, as and when required, the user can select to move the guard to the second, opened position in the recess to be able to bring the edge of the blade of the drum closer to the edge of a workpiece than would be possible if the guard was in the first, closed position.

Furthermore, preferably, the guard is required to be held in the opened position by the user holding the same open by holding the lever. This means that both of the user's hands are holding handles on the planer in use and, therefore, are well removed from the opened drum chamber and, therefore, provide the required level of safety.

In one embodiment, the lever is movable around an arcuate guide which, in turn, operates a rack connected to a pinion which, in turn, is located with the guard.

In one embodiment, the rack includes one or more ramps which force the guard to move between the intermediate position and the opened position as the lever is moved, such that the guard movement occurs automatically with a single movement of the lever by the user.

In a further aspect of the invention, there is provided a power tool planer incorporating a base which contacts with a workpiece from which portions of material are to be removed by the tool passing therealong and a housing depending from the base and in which is mounted a drum in a chamber. The drum includes at least one blade mounted thereon. The drum is driven by a motor provided as part of the tool to rotate and move the blades into contact with the workpiece to remove material therefrom, wherein there is provided a guard selectively positionable in a recess in the housing such that the external surface of the guard lies substantially flush with an adjacent side wall of the housing.

In a further aspect of the invention, there is provided a power tool planer incorporating a base for movement along a workpiece to remove material therefrom, a housing, and a drum mounted within a chamber in the housing. The drum incorporates one or more blades. The tool being provided to be moved in a forward direction to allow removal of material from the workpiece as the blade drum is driven by a motor provided as part of the tool. The power tool further includes a dust and debris extraction system incorporating at least one passage depending from the chamber along which dust and debris created during the use of the power tool can pass. The passage leads to a diversion device selectively connectable with first and second exit ports, a first port mounted on one side of the housing and a second port located on the opposing side of the housing or rear of the housing. The diversion device incorporates a rotatable assembly which can be selectively positioned to cause the dust and debris from the passage to exit via the first or second port.

Typically, the diversion means incorporates a user actuable member positioned externally of the housing which can be moved by the user to select from which of the two ports the dust or debris leaves the housing. Typically, the actuation member is formed to provide a visual indication of which of the ports dust or debris will leave the housing. Typically, the visual indication is provided in the form of a pointer and a label to point toward the particular port which is opened at any given time.

Typically, the diversion means includes a diverting assembly to seal off the port not used for extraction of the dust. Typically, the diverting assembly is formed with a channel, such that dust and debris is efficiently obtained from the passage which extends substantially across the width of the drum.

Typically, the diverting assembly is provided such that the passage of the dust and debris through the diverting assembly is along a channel of substantially the same width as the passage leading from the chamber. This, therefore, means that the opportunity for dust or debris to clog up the diversion means is minimized. In one embodiment, the channel is shaped such that the passage of the dust and debris is accelerated through the passage.

In a further aspect of the invention, there is provided a power tool planer incorporating a base to contact the surface of a workpiece from which material is to be removed by use of the power tool, a housing depending from the base and, within the housing, there is provided a drum with one or a plurality of blades mounted thereon, which drum is selectively positionable with respect to the base of the tool to determine the depth of cut by the blade, and wherein there is provided an assembly to allow the depth of cut to be adjusted by a user. The assembly includes an axial member connected to the base to cause movement of the base with respect to the drum to adjust the depth of cut, and a gear assembly connected to a winder. The winder selectively actuable by the user to move the axial member.

In one embodiment, the axial member incorporates a carrier on which a plurality of planetary gears are mounted in conjunction with a sun gear. The planetary gears and sun gear are mounted within an outer ring also located on the carrier and the winder is located to cause rotation of the gear assembly and, hence, movement of the carrier with respect to the housing on which the same is mounted. Typically, the carrier axial member is mounted within an enclosure provided in a fixed relationship with the housing.

The dust and debris extraction means and/or depth adjustment means and/or movable guard are preferably all provided on the same planer but can be provided independently of each other.

BRIEF DESCRIPTION OF THE DRAWINGS

Specific embodiments of the invention will now be described with reference to the accompanying drawings, wherein.

DETAILED DESCRIPTION OF THE INVENTION

Figure 1:
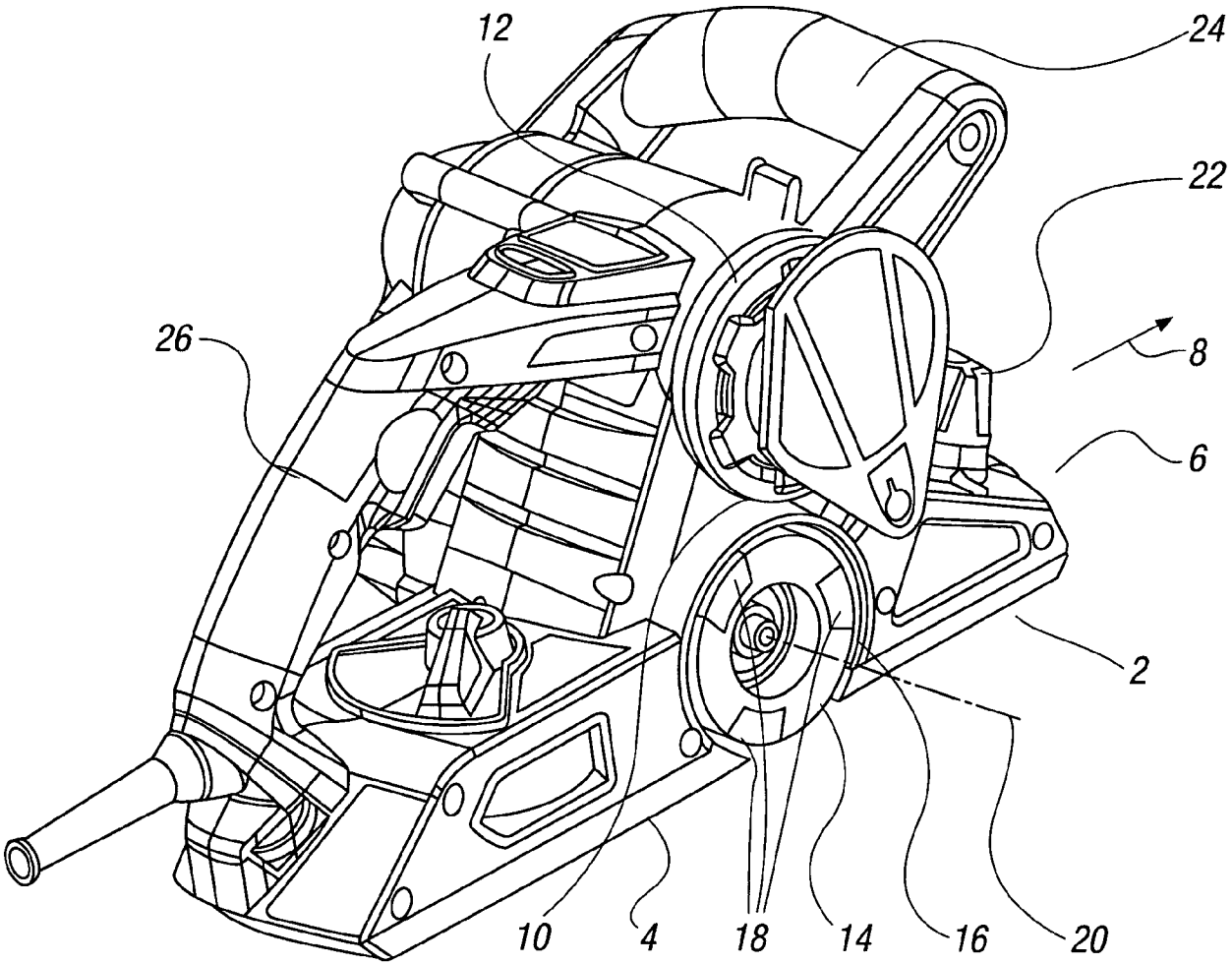
FIG. 1 illustrates a perspective view of the planer tool in accordance with one embodiment of the invention.

Referring first to FIG. 1, there is illustrated a planer power tool 2. The power tool incorporates a base 4 designed to pass along a workpiece surface (not shown) from which portions of material are removed using the tool. The tool has a front end 6 and is designed to be moved in a direction of arrow 8 along a workpiece. The power tool has a housing 10 in which is located a motor 12 connected to drive and rotate a drum 14 mounted in a chamber 16. The drum has a plurality of blades 18 at spaced intervals there around and is designed to be rotated about an axis 20 by the motor. The base position with respect to the drum can be selectively adjusted via adjustment means 22 by a user to control the depth from which the blades protrude below base 4 and, hence, select a depth of cut made on a workpiece. Dust and debris extraction means can be provided, and these will be described subsequently in more detail. A user grips the power tool via handles 24 and 26 to guide movement of the tool along a workpiece.

Figure 2:
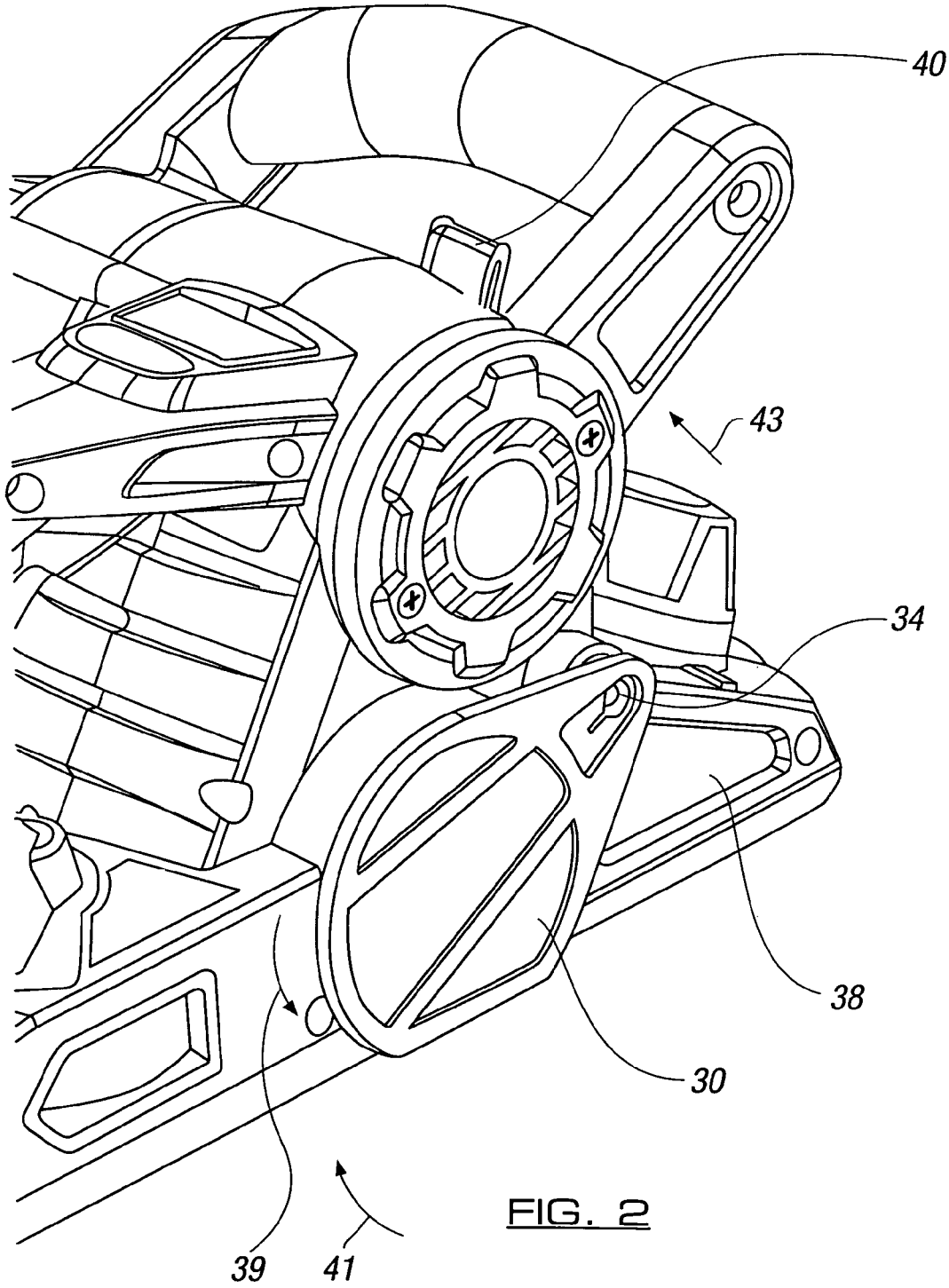
FIG. 2 illustrates the forward portion of the tool of FIG. 1 in detail showing the drum guard in a closed position.
Figure 3:
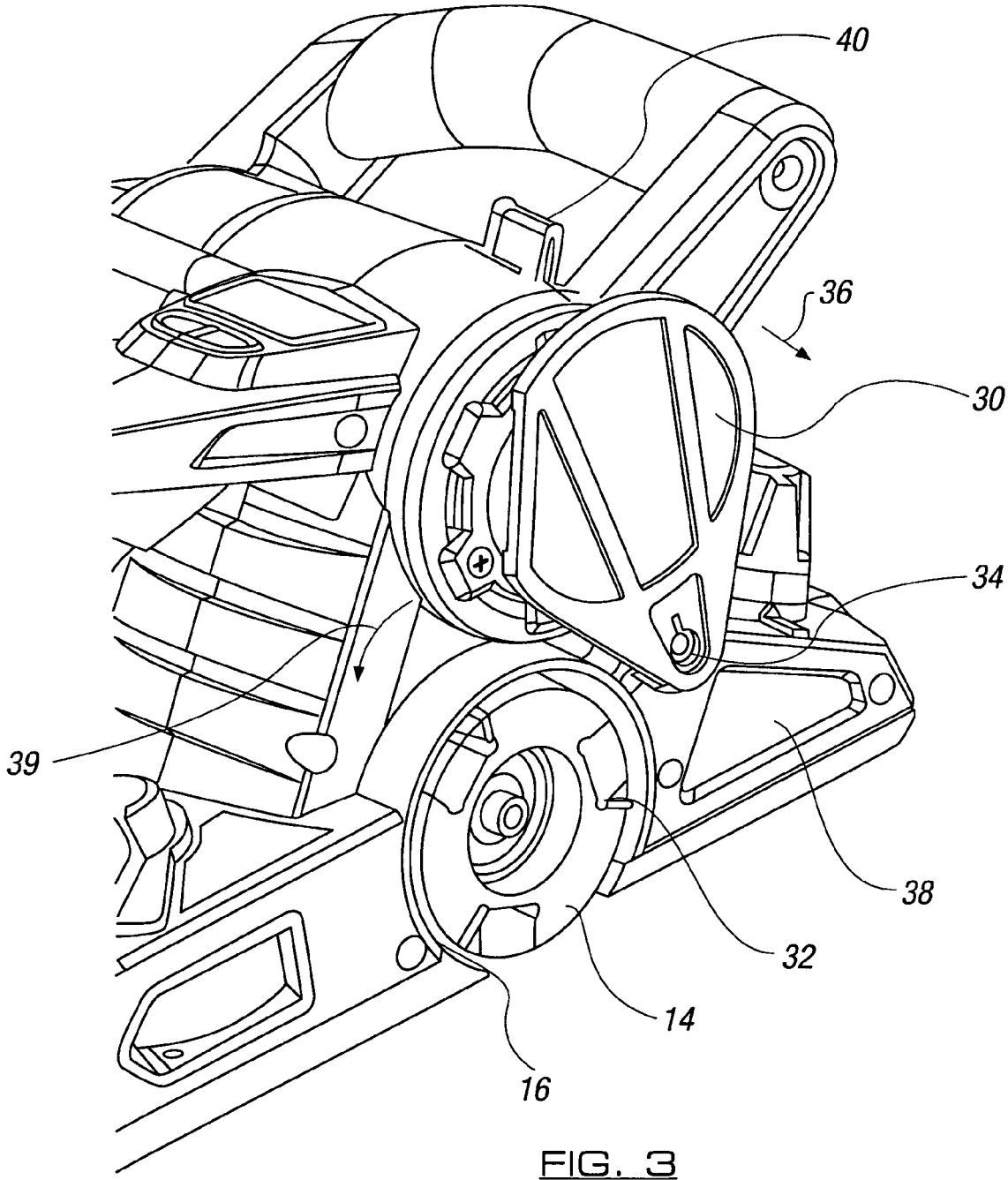
FIG. 3 illustrates the portion of the tool of FIG. 2 with the drum guard in an opened position.

FIGS. 2 and 3 illustrate a first aspect of the invention in more detail, and this relates to the provision of a guard 30 mounted movable between a closed position, shown in FIG. 2, and an opened position, shown in FIG. 3. The guard is provided to allow selective access to opening 32 of chamber 16 in which drum 14 is located. This may normally be required to allow the removal of the drum for cleaning and/or removal of debris from the chamber and/or to allow one or more blades mounted on the drum to be removed.

The guard is movable between opened and closed positions about a pivot axis location 34 and, in accordance with the invention, is movable with two movement components. Thus, from the second, opened position, shown in FIG. 3, to the first, closed position of FIG. 2, the guard is first moved with an axial component from the recessed open position, outwardly of the housing as indicated by arrow 36. Once the guard is then clear of a side face 38 of the housing and has hence moved from a substantially flush recessed position, the guard can then pivotally move about pivot axis location 34, as indicated by arrow 39, to the first, closed position in FIG. 2. To move from the closed position of FIG. 2 to the opened position of FIG. 3, the first movement is pivotal as indicated by arrow 41 in FIG. 2 and then inwardly, as shown by arrow 43, to move the guard to the recessed position of FIG. 3.

Figure 4:
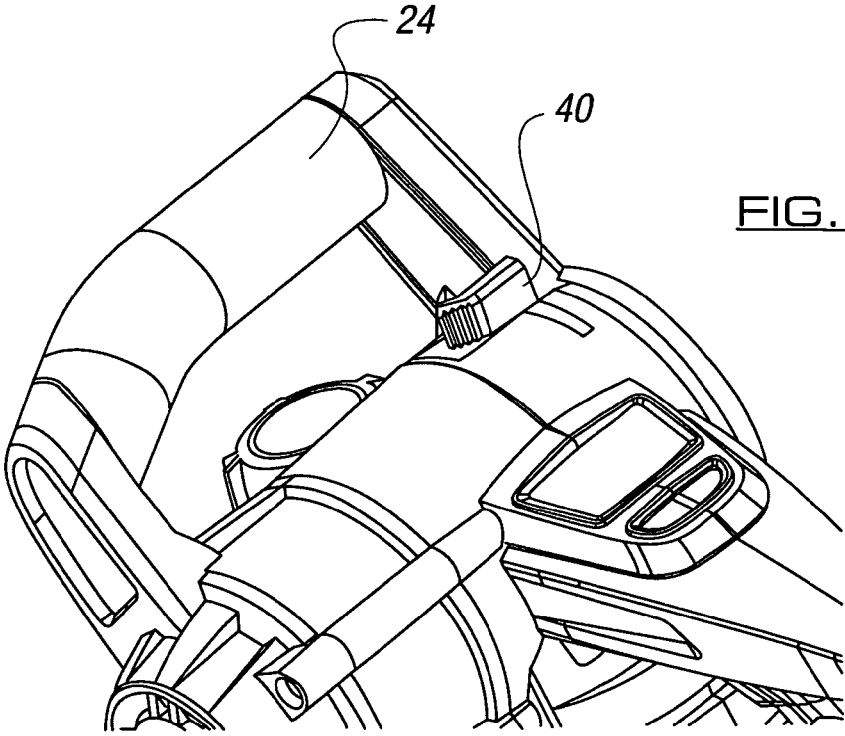
FIG. 4 illustrates a top portion of the tool of FIG. 1 with a user actuation lever for the drum guard.
Figure 5:
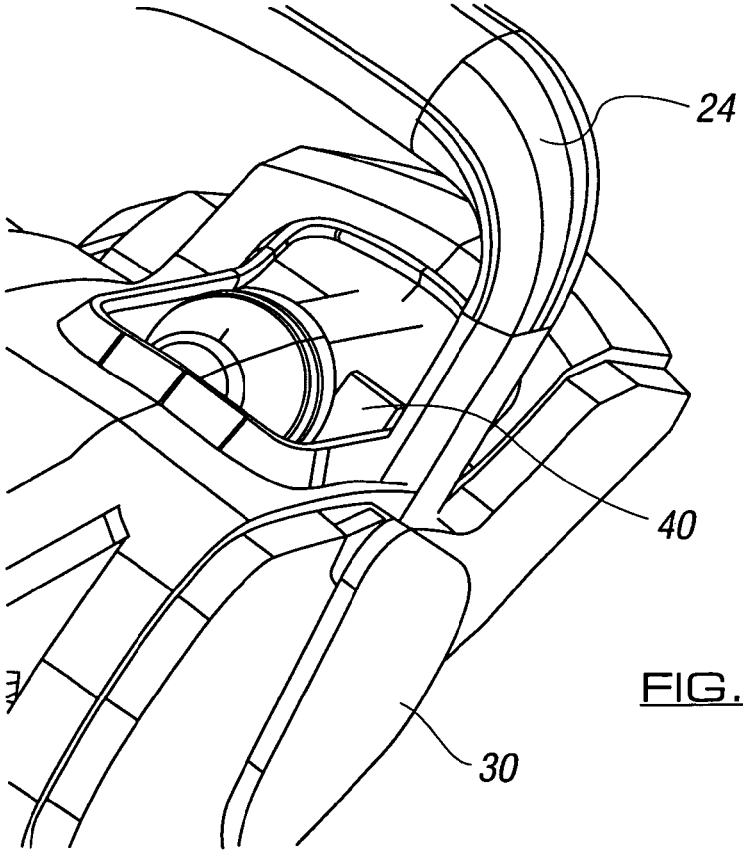
FIG. 5 illustrates a top portion of the tool of FIG. 1 with an alternative arrangement of the user actuation means for the drum guard.
Figure 6:
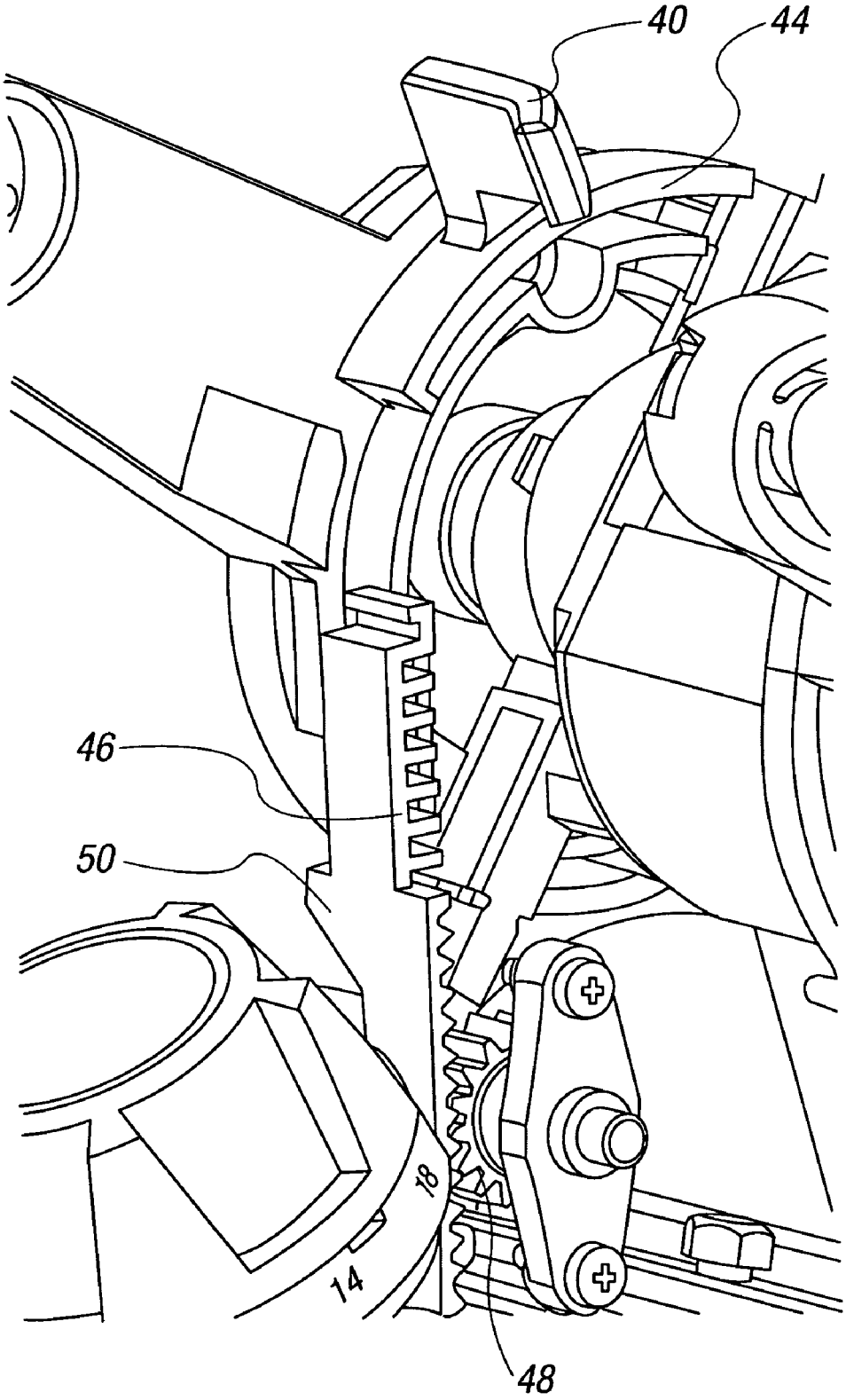
FIGS. 6 and 7 illustrate internal views of the housing of the tool showing a mechanism for movement of the drum guard in accordance with one embodiment.
Figure 7:
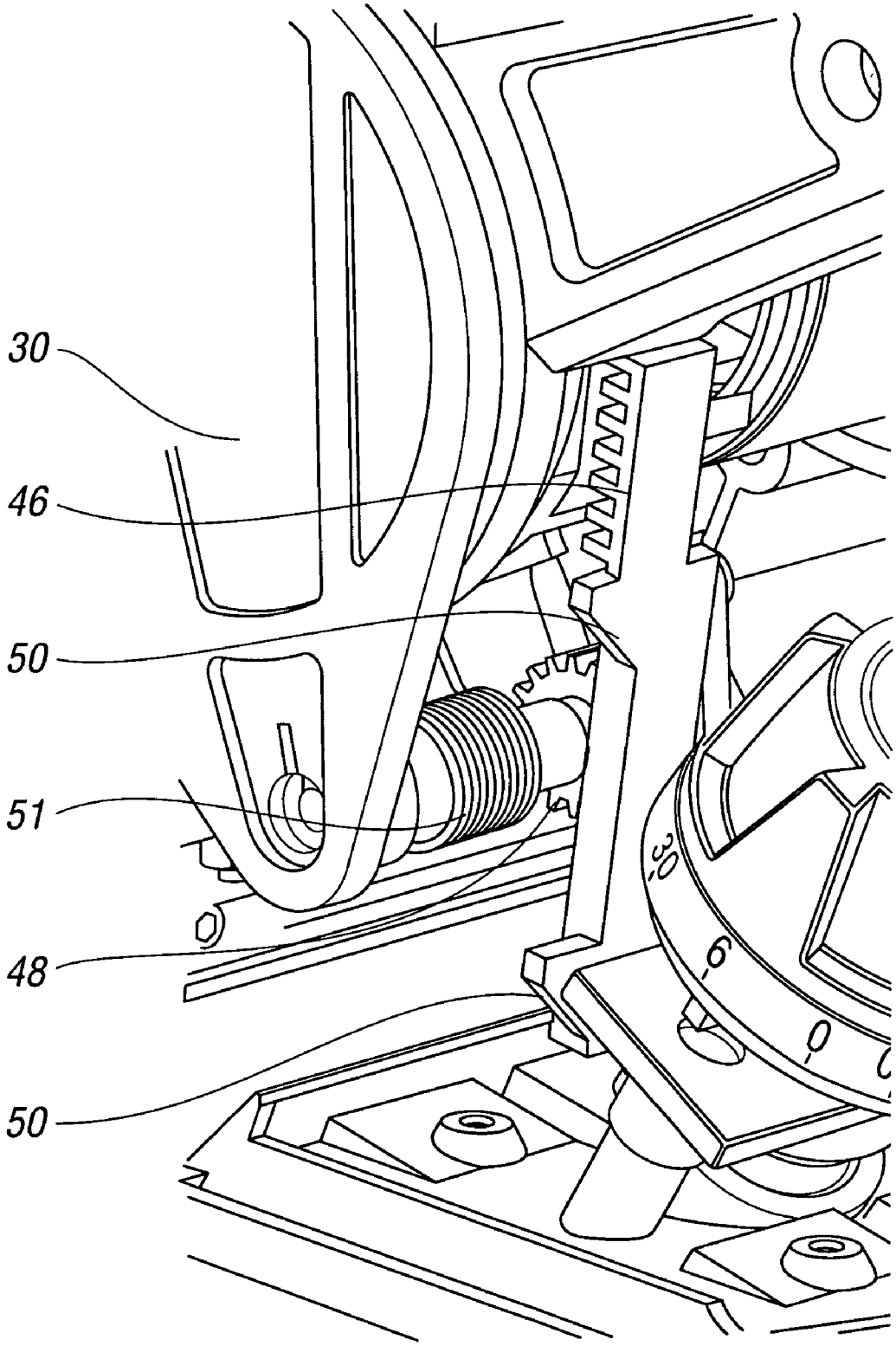
Figure 8:
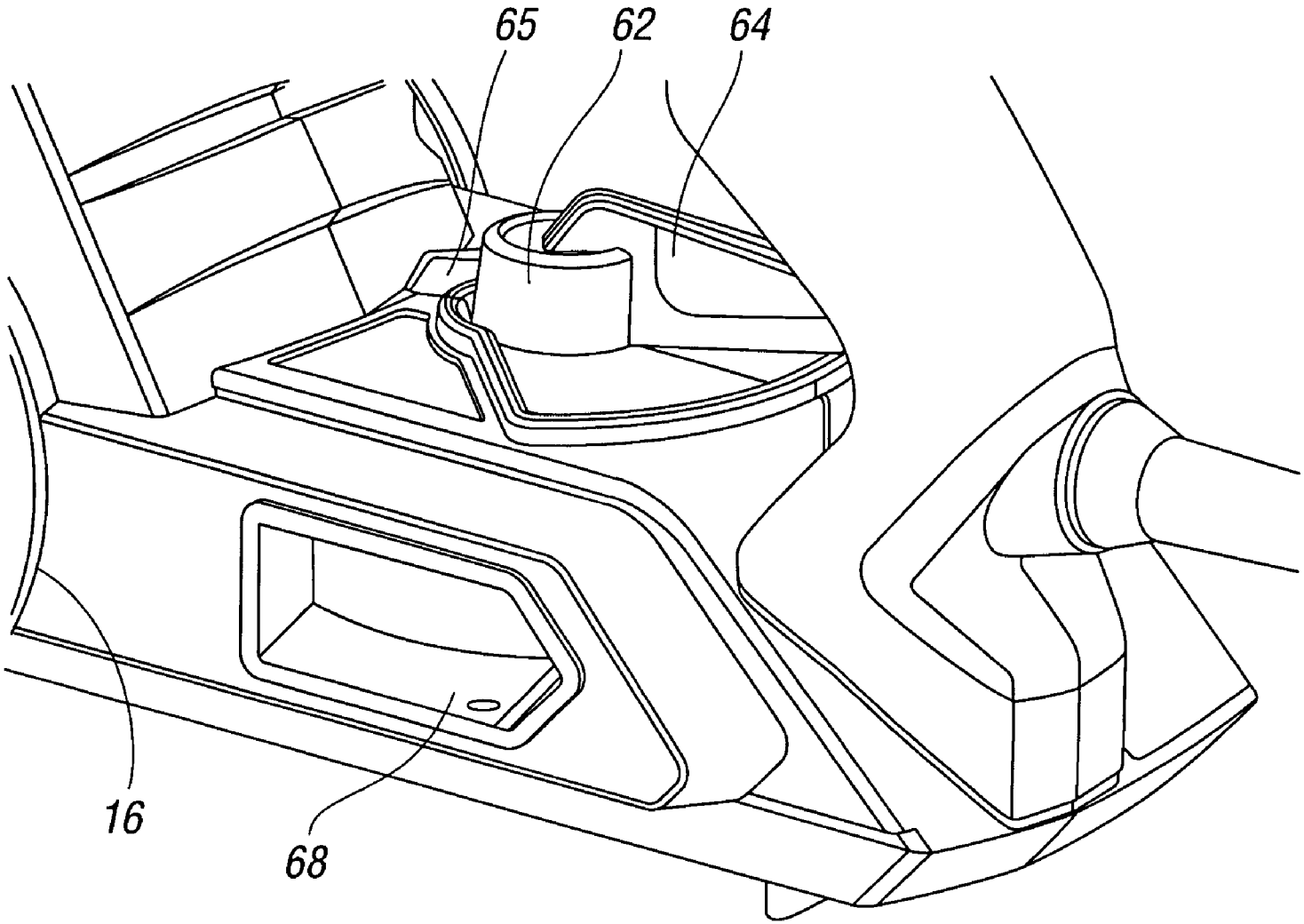
FIG. 8 illustrates a rear portion of the tool of FIG. 1 showing a dust extraction port.

This movement can be achieved via user manipulation of an actuating device 40 which, in the case of FIG. 4, is a lever and in the case of FIG. 5 is a slide. In each case, actuating means 40 is located adjacent to handle 24 to allow the same to be operable by a user while holding the planer tool in use via handle 24. In both cases, the movement of the actuating means, whether that be in a straight line or an arcuate line, causes operation of a mechanism connected to the guard, an example of which is shown in FIGS. 6 and 7. The example is shown with the housing removed for ease of reference. Actuating means 40 shown in this case is of the type shown in FIG. 4, but it should be appreciated that operation is similar regardless of the actuating device 40 used.

Preferably, the guard is biased to the closed position via one or more resilient means, such as springs 51. The resilient means is located to provide biased movement with respect to the two components of movement. This, therefore, means that as soon as the actuating means is released when the guard is in the opened position, the guard will automatically return to the closed position.

In one embodiment, a compression spring is provided for the axial movement component and a torsion spring is provided for the pivotal movement component. In one embodiment, the biased movement is damped to prevent damage to the guard and/or workpiece.

Typically, the actuating means will include a pointer or other indication means to indicate the position that the guard is in at any given instant.

In one embodiment, the guard, in addition to being movable under the influence of the actuating means, is also movable if it impacts with a workpiece surface such that as the planer is moved forward the guard may be moved to the opened position by impact with a workpiece, thereby allowing continued operation of the planer along the intended line of operation.

When the guard is in the opened position, the drum can be removed by insertion of a tool into the drum shaft to release a fastener and allow removal of the drum In FIGS. 6 and 7, the actuating means 40 is movable along an arcuate guide 44 and is connected to move a rack 46. The rack is connected to a pinion 48 which, in turn, is connected to guard 30 to cause pivotal movement of the same as the rack moves and the pinion rotates. Also, provided on the rack are ramp portions 50 which cause the guard, when it reaches the intermediate position, to then move axially with respect to the axis and, hence, move to the flush, opened position or alternatively move in the reverse direction away from the flush position to the intermediate position which is clear from the housing.

The ability to move the guard to the opened recessed position means that the planer housing can be moved closer to an edge or obstruction when the same is being moved along a workpiece and, therefore, increases the accessibility of the planer in terms of possible locations of use.

Figure 9:
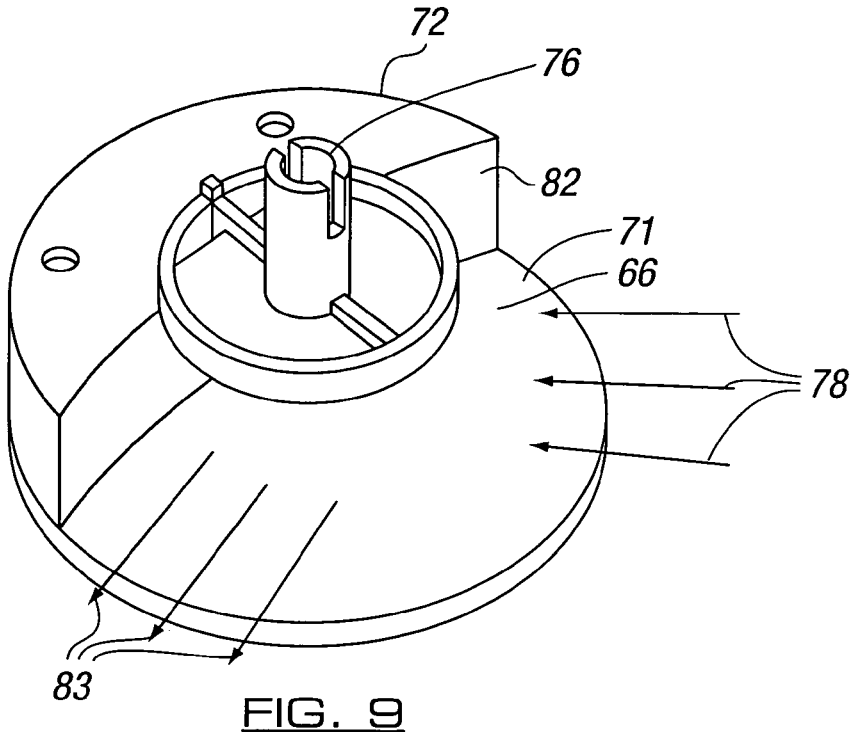
FIG. 9 illustrates a dust and debris diverting assembly in accordance with one embodiment of the invention.
Figure 10A:
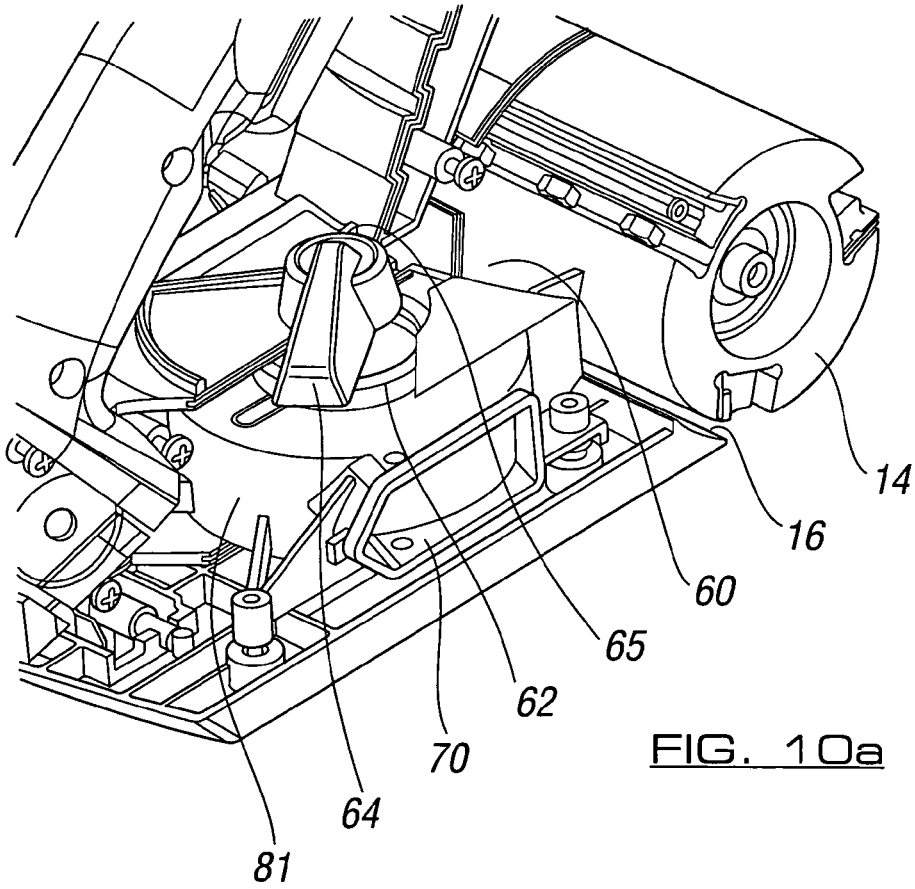
FIGS. 10*a* and *b* illustrate a dust and debris extraction system and casing therefore.
Figure 10B:
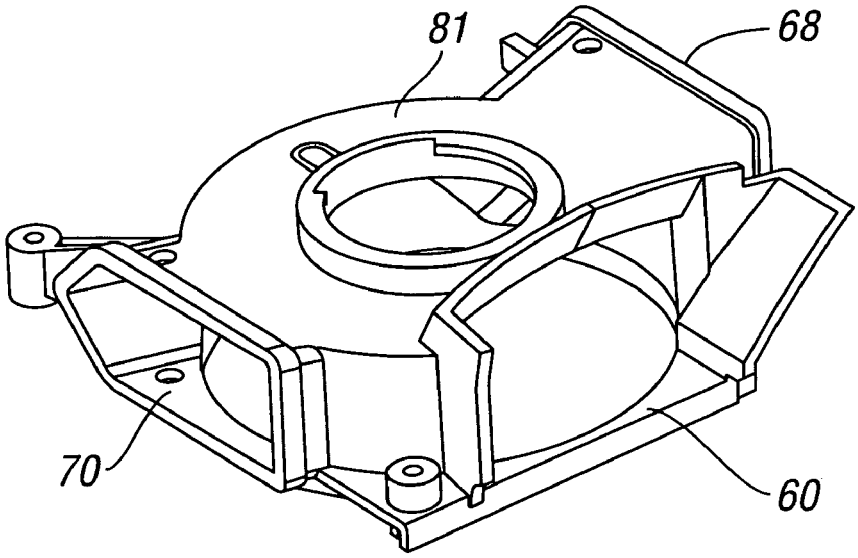

Also, provided within the housing in a further aspect is a dust and debris collection device. This collection means incorporates a passage 60 which passes from a rear of chamber 16 in which the blade drum is located, and which passage leads to a diversion means 62 located to the rear of the chamber. The diversion means is connected to an external member 64 which is preferably formed with a pointer 65 for reasons which will be described subsequently. The member is connected axially to a diverting assembly 66, illustrated in FIG. 9, and is located with respect to first and second ports 68 on one side of the housing and 70 on the opposing side of the housing via casing 81 of the diversion means shown in FIG. 10*b* and in which the diverting assembly 66 is mounted and which is located in the housing of the tool as shown in FIG. 10*a*. At any given time, one of the ports 68, 70 can be opened and the other port can be closed via the diverting assembly, depending on the position of the diverting assembly with respect to the ports.

The diverting assembly incorporates a channel 71 which is preferably of substantially the same width as passage 60 which leads from the chamber, thus ensuring that the volume of debris from passage 60 can pass through channel 70 of the diverting assembly without the same causing clogging up or blockage of the overall dust extraction system. The diverting assembly also has a wall 72 positioned adjacent one of the ports to cause that port to be sealed and closed. The movement of the diverting assembly is achieved via actuating means 64 mounted on a spigot 76 of the assembly, and the diverting assembly is, in turn, mounted within a casing 81 which serves to locate and guide movement of the diverting assembly. Typically, actuating member 64 is located and formed with pointer 65 to indicate to a user which of the ports is open at any given time, typically in conjunction with a label or other indication means (not shown) applied to the housing.

Furthermore, an inside wall 82 of the diverting assembly is designed to accelerate the dust or debris from passage 60 (which is indicated by the arrows 78 in FIG. 9) via the shape of wall 82 towards the particular port (as indicated by arrows 83) which is opened at that time and into, typically, a vacuum adaptor or dust collection bag connected to the port. The acceleration of dust or debris from the housing clears the area around the drum and, thus, prevents the opportunity of clogging and also forces the dust or debris into the bag collection means.

Figure 11:
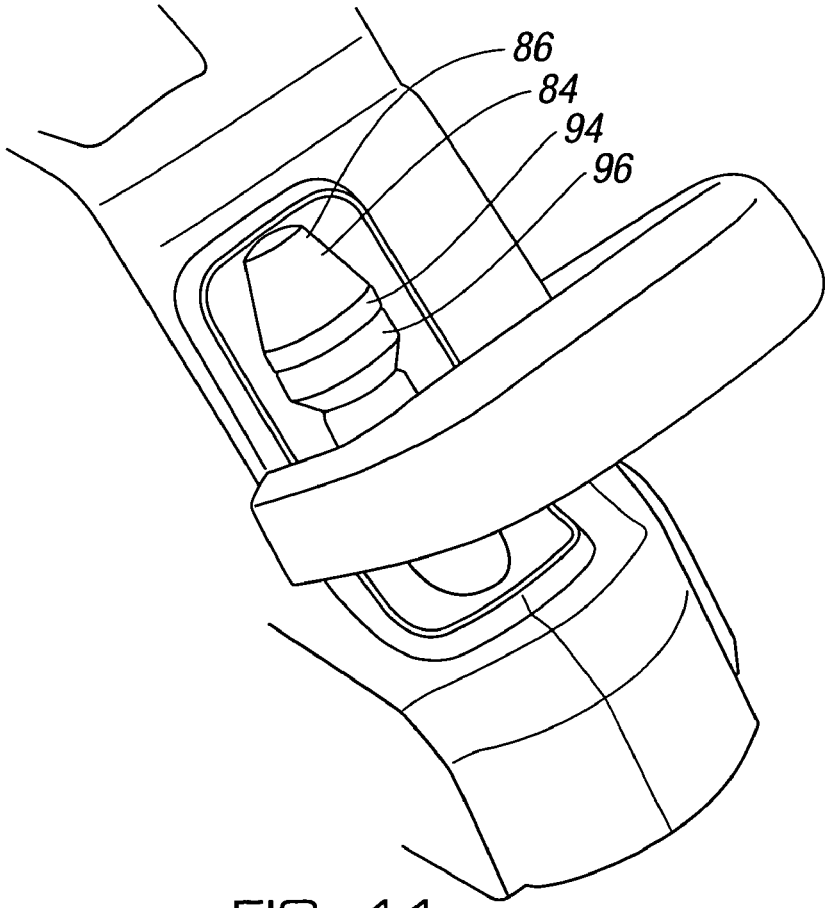
FIG. 11 illustrates the further embodiment of the invention showing a depth adjustment means.
Figure 12:
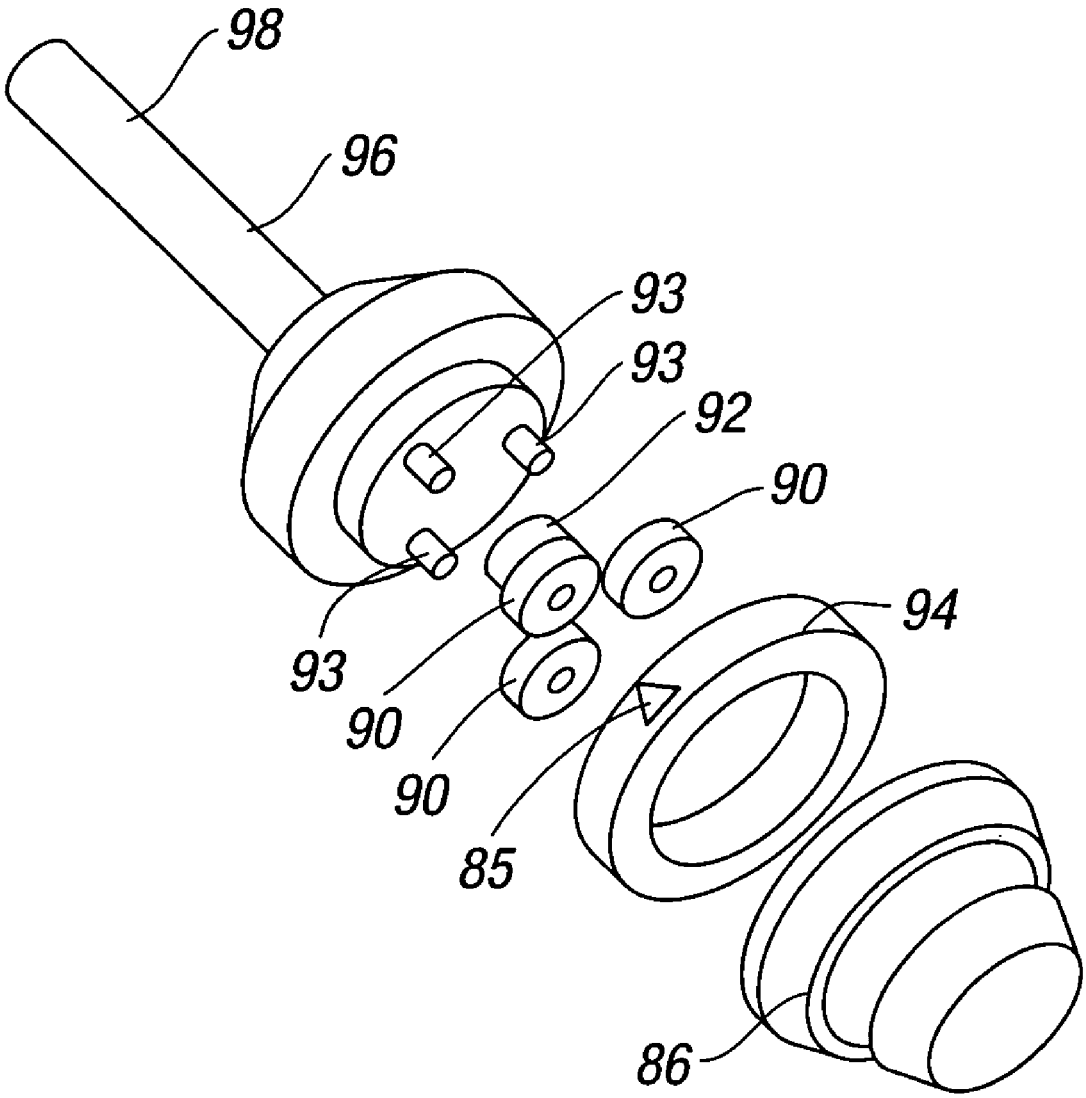
FIG. 12 illustrates an exploded diagram of the depth adjustment means of FIG. 11.

FIGS. 11 and 12 illustrate a further embodiment of the invention in which there is provided a depth of cut adjustment mechanism 84. In this case, the depth of cut can be created by the user rotating a winder 86 which is connected to a gear assembly 88 which comprises three planetary gears 90, on spigots 93 and a sun gear 92 which are located within an outer ring 94. The provision of the gear assembly, which is located on axial carrier 96, is to allow adjustment of the base of the planer with respect to the drum and, thereby, allow the depth of cut to be adjusted by a free end 98 of the carrier contacting the base. This means that the rotation of winder 86 by a user is amplified by the gear assembly and, hence, amplifies the input force and increases the number of rotations required to index a front shoe. This, therefore, means that less input force is required from the user, and improved control and greater resolution of a particular depth, which is set via the control device, is achieved. In addition, a particularly effective scale can be provided by providing a pointer 85 on the fixed outer ring 94 and a scale (not shown) on the moving portion of carrier 96 so that the user can easily see the particular adjustment which is being made. The rotation may also be provided in a detented manner.

The improvements as herein defined, independently or in combination, provide effective benefits to the use of the planer and as a result the user thereof.

The invention claimed is:

1. A handheld planer power tool, said tool comprising:

a base which contacts with a top surface of a workpiece from which portions of material are to be removed by the tool passing therealong;

a housing depending from the base and in which is mounted a drum in a chamber;

the drum including at least one blade mounted thereon, the drum driven by a motor provided as part of the tool to rotate and move the blades into contact with the workpiece to remove material therefrom; and said planer power tool including a guard which is located to be movable between a first position masking an opening to one side of the chamber in which the blade drum is mounted, and a second position in which the opening to the chamber is exposed and in which the guard lies in a recess in the housing, wherein the guard has two movement components between the first and second positions, the first movement component being a pivotable movement from the first position to an intermediate position wherein said guard pivots from a point located at an offset distance from the opening into the chamber and the second movement component being an axial movement from the intermediate position to the second position; wherein said guard is moved between said first and intermediate positions and between said intermediate and second positions via user operation of an actuation member located on the housing.

2. The tool according to claim 1 wherein said actuation member is located at a position remote from said guard.

3. The tool according to claim 2 wherein said actuation member is mounted adjacent to a gripping handle provided on said housing.

4. The power tool according to claim 1 wherein said guard is biased towards said first position and is required to be retained in said second position by a user holding an actuation member connected to said guard.

5. The power tool according to claim 4 wherein said actuation member is connected to said guard via a rack and pinion assembly.

6. The power tool according to claim 5 wherein said rack includes one or more ramps to force said guard to move between an intermediate position and said second position as said actuation member is moved.

7. A handheld planer power tool, said tool comprising:

a base which contacts with a top surface of a workpiece from which portions of material are to be removed by the tool passing therealong;

a housing depending from the base and in which is mounted a drum in a chamber;

the drum including at least one blade mounted thereon, the drum driven by a motor provided as part of the tool to rotate mad move the blades into contact with the workpiece to remove material therefrom;

a guard in a recess in the housing is movable between first and second positions, a first position masking an opening to one side of the chamber in which the blade drum is mounted, and a second position in which the opening to the chamber is exposed; and wherein said guard is biased towards said first position and is required to be retained in said position by a user holding an actuation member connected to said guard via a rack and pinion assembly wherein the rack includes one or more ramps to force said guard to move between an intermediate position and said second position as said actuation member is moved.

* * * * *